US005490331A

United States Patent [19]

Gold

[11] Patent Number: 5,490,331

[45] Date of Patent: Feb. 13, 1996

[54] UTILITY KNIFE FOR CUTTING AND SCRAPING

[76] Inventor: Peter Gold, 465 N. Wood Rd., Rockville Centre, N.Y. 11570

[21] Appl. No.: 451,460

[22] Filed: May 26, 1995

[51] Int. Cl.[6] ..... B25F 3/00

[52] U.S. Cl. ..... 30/143; 30/162; 30/169

[58] Field of Search ..... 30/143, 162, 169, 30/335, 340, 2; 15/236.01; D32/46–49

[56] References Cited

U.S. PATENT DOCUMENTS

| | | | |
|---|---|---|---|
| 2,174,388 | 9/1939 | Myers | 30/340 X |
| 3,651,571 | 3/1972 | Neale | 30/162 |
| 3,672,051 | 6/1972 | Ramiccio | 30/162 X |
| 4,897,920 | 2/1990 | Dunbar | 30/162 X |
| 4,920,645 | 5/1990 | Baudouin | 30/162 |
| 5,107,593 | 4/1992 | Hutchins | 30/169 X |

*Primary Examiner*—Douglas D. Watts

[57] ABSTRACT

For a scoring or utility knife typically used in a cutting stroke by being pulled toward the user, the use for assembling together right and left housings serving as a compartment for a retractable blade and as a hand grip, of a screw characterized by a laterally extending cylindrical head which is positioned to be engaged by a thumb of the hand grip to supplement the grip about the knife during its use, and also a front depending abutment to facilitate pushing the knife in a scraping stroke directionally away from the user.

1 Claim, 1 Drawing Sheet

UTILITY KNIFE FOR CUTTING AND SCRAPING

The present invention relates generally to improvements for a utility knife with a retractable blade honed to a high degree of sharpness along selected edges wherein, more particularly, the improvements contribute to the safe handling and use of the cutting function noted of this knife.

EXAMPLE OF THE PRIOR ART

In popular use are various models of a utility knife as exemplified by the knife illustrated in Des. U.S. Pat. No. 336,029 issued to Ragland et al. for "Retractable Blade Utility Knife" on Jun. 1, 1993. To embody a cutting function to the knife it includes a retractable blade normally stored within a housing, also serving as a hand grip, that a user uses to pull the blade through a substrate, such as a cardboard panel, in a cutting stroke toward the user. During the cutting stroke it is not unusual for a difficult-to-cut material to be encountered, such as adhered tape or the like, located in the path of the cutting stroke which causes the hand grip to slip off the housing which interferes with the cutting service of the knife and even results in injury.

Occasions also arise which require scraping a label from a glass or similar surface, which contemplates urging an appropriately oriented blade edge in directional movement away from the user, which is a degree of utility not readily possible with any known prior art utility knife, and specifically the utility knife of Des. U.S. Pat. No. 336,029.

Broadly, it is an object of the present invention to provide a utility knife overcoming the foregoing and other shortcomings of the prior art.

More particularly, it is an object to provide a utility knife constructed so that directional cutting strokes toward, and directional scraping strokes away from the user are greatly facilitated, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
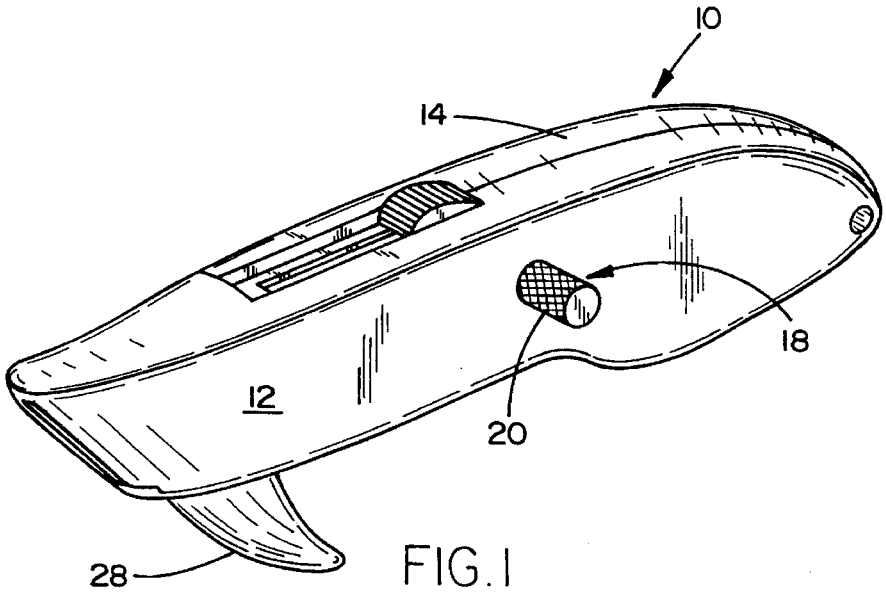
FIG. 1 is a perspective view of the within inventive scoring knife.

As shown in FIG. 1, the within inventive utility knife, generally designated 10 is of a type having two housings 12 and 14 serving as a hand grip as well as an enclosure for a retractable cutting blade 16. In the half hand grips or housings 12, 14 there are threaded openings which align with each other so that threadably disposed in these openings to complete the assembly of the housings 12, 14 to each other is a screw, not heretofore known to be used in the assembly of the housings 12, 14, generally designated 18, having a threaded shank sized in diameter and thread pitch to threadably engage in the housing aligned openings and, most important, having a larger diameter cylindrical knurled head 20, of approximately in a preferred embodiment of ½ inch axial dimension, by which the head 20 extends laterally of the knife 10 and thus serves, as may readily be understood from FIG. 2, as an additional grip during cutting use of the knife 10, since a thumb 22 of the hand grip 24 of the user is readily in reach of the head 20 and thus is positioned to advantage about the cylindrical head 20 to facilitate executing cutting strokes with the knife 10.

Figure 2:
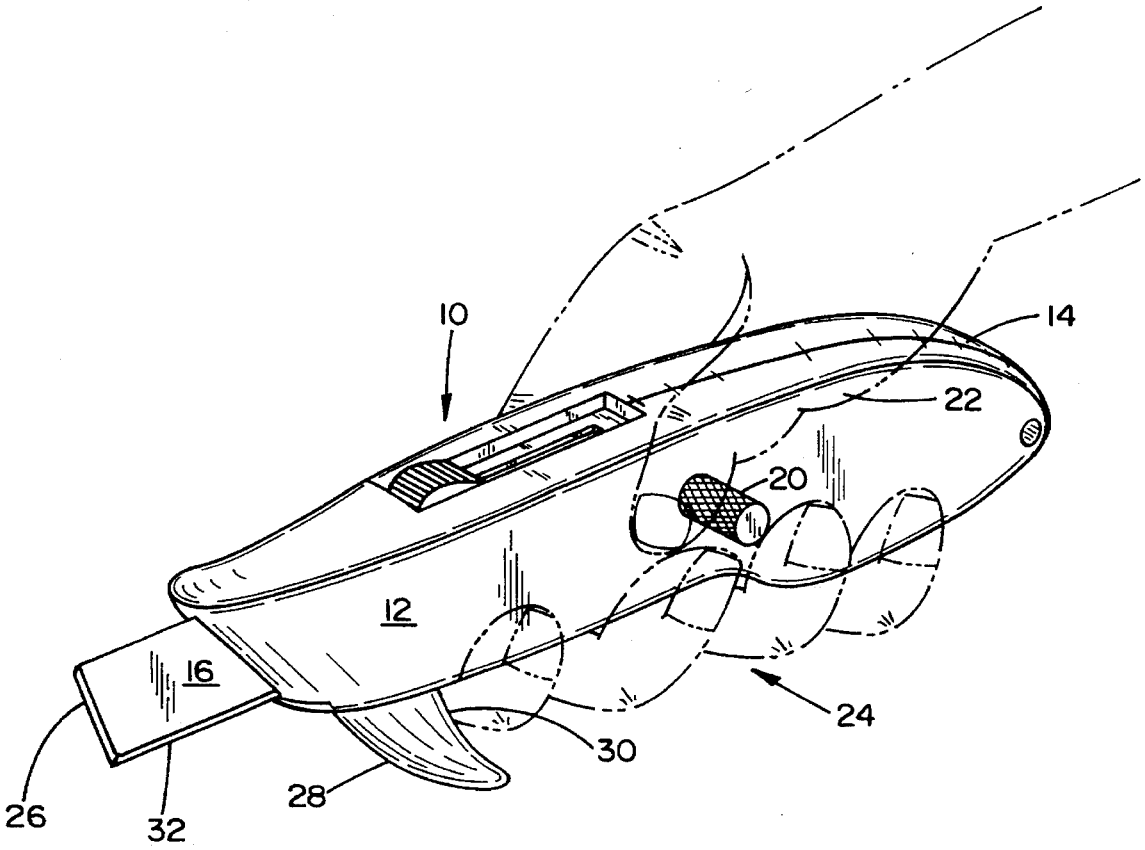
FIG. 2 is similarly a perspective view illustrating a typical use of the utility knife.

Additionally, occasions also arise which require a scraping utility in the knife 10, namely the urging in movement away from the user of the knife 10 so that a honed edge 26 at the distal location illustrated on the blade 16, and which honed edge 26 is transverse to the directional movement away from the user, is in an advantageous position to peel or scrape a label off of a glass surface, such as the inspection sticker from an auto windshield, or the like, and this is facilitated in the contemplated use of the knife 10 by the provision of a depending finger-contacting member 28 strategically located at the front end of the knife 10. As shown in FIG. 2, the member 28 serves as a stop against which the hand grip 36 abuts, as at 36, during the forward pushing or scraping stroke of the knife 10.

In summary, underlying the present invention is the recognition that knife 10 is a pulling cutting implement, in that the blade honed cutting edge 32 is along the bottom thereof and in facing relation from above to a below-positioned cardboard or other substrate to be cut and the provision of the laterally extending screw head 20, which is readily gripped, facilitates this directional cutting utility, and also that it is required to be used in a pushing directional scraping stroke bringing into play the transverse honed edge 26, and that this use is significantly facilitated by the front depending finger-contacted grip 28.

While the utility knife 10 herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for cutting directionally toward and scraping directionally away from a user of a utility knife having screw-attached cooperating left and right housings bounding a storage compartment therebetween for a retractable blade adapted to be projected from a front end of said housings incident to said housings serving as a hand grip during the use of said blade, said improvements for said cutting comprising a first honed edge on said blade in facing relation from above to a below-positioned substrate adapted to be cut incident to a directional cutting stroke toward a user, and a screw for attaching said housings together characterized by a cylindrical head of not less than ½ inch in axial length extending laterally of said utility knife so as to serve as a grip for a thumb of a user's hand grip disposed thereabout to facilitate pulling said utility knife during said directional cutting stroke, and said improvements for said scraping comprising a second honed edge on said blade in transverse relation to a directional scraping stroke away from a user, and a finger-contact means attached in depending relation adjacent said front end of said utility knife to facilitate pushing said utility knife during said directional scraping stroke, whereby said utility knife has enhanced utility for cutting and scraping.

* * * * *